US011340642B2

(12) United States Patent
Hsu et al.

(10) Patent No.: US 11,340,642 B2
(45) Date of Patent: May 24, 2022

(54) LOW DROPOUT REGULATOR AND CONTROL METHOD THEREOF FOR MAINTAINING OUTPUT VOLTAGE VALUE OF LOW DROPOUT REGULATOR

(71) Applicant: NANYA TECHNOLOGY CORPORATION, New Taipei (TW)

(72) Inventors: Hao-Huan Hsu, Taoyuan (TW); Lin-Chen Yen, Taipei (TW)

(73) Assignee: NANYA TECHNOLOGY CORPORATION, New Taipei (TW)

( * ) Notice: Subject to any disclaimer, the term of this patent is extended or adjusted under 35 U.S.C. 154(b) by 30 days.

(21) Appl. No.: 16/910,081

(22) Filed: Jun. 24, 2020

(65) Prior Publication Data

US 2021/0405672 A1 Dec. 30, 2021

(51) Int. Cl.
*G05F 1/575* (2006.01)

(52) U.S. Cl.
CPC ..... *G05F 1/575* (2013.01)

(58) Field of Classification Search
CPC ..... G05F 1/575; G05F 1/462; G05F 1/465; G05F 1/468; G05F 1/56; G05F 1/562; G05F 1/565; G05F 1/567; G05F 1/569; G05F 1/571; G05F 1/573; G05F 1/5735
See application file for complete search history.

(56) References Cited

U.S. PATENT DOCUMENTS

2011/0089916 A1* 4/2011 Soenen ..... G05F 1/575 323/280
2014/0084881 A1* 3/2014 Shih ..... G05F 1/565 323/269
2017/0063223 A1* 3/2017 Raghupathy ..... G05F 1/56

FOREIGN PATENT DOCUMENTS

CN 104777869 A 7/2015

* cited by examiner

*Primary Examiner* — Thienvu V Tran
*Assistant Examiner* — Nusrat Quddus
(74) *Attorney, Agent, or Firm* — CKC & Partners Co., LLC

(57) ABSTRACT

A low dropout regulator is disclosed. The low dropout regulator includes an amplifier, a transistor, and a selector. The transistor is coupled to the amplifier. The selector is coupled to the amplifier and the transistor. When a supply voltage value of the transistor is less than a supply voltage threshold value, a first path of the selector is selected and a first selector voltage value is transmitted by the selector to the transistor so as to fully conduct the transistor, and an output voltage value of the transistor is equal to the supply voltage value.

10 Claims, 4 Drawing Sheets

LOW DROPOUT REGULATOR AND CONTROL METHOD THEREOF FOR MAINTAINING OUTPUT VOLTAGE VALUE OF LOW DROPOUT REGULATOR

BACKGROUND

Technical Field

The present disclosure relates to a low dropout regulator and a control method thereof. More particularly, the present disclosure relates to a low dropout regulator and a control method thereof for maintaining the output voltage value of the low dropout regulator.

Description of Related Art

The common supply voltage value of the low dropout regulator (LDO) was 1.2 V. However, when the supply voltage value became lower than default value. It induced larger error of LDO output voltage value and provided smaller driving current. When the supply voltage value was close to target LDO output voltage value, for example, when the difference between the supply voltage value and the target LDO output voltage value, the previous design was difficult to maintain target LDO output voltage value.

SUMMARY

An aspect of the present disclosure is to provide a low dropout regulator. The low dropout regulator includes an amplifier, a transistor, and a selector. The transistor is coupled to the amplifier. The selector is coupled to the amplifier and the transistor. When a supply voltage value of the transistor is less than a supply voltage threshold value, a first path of the selector is selected and a first selector voltage value is transmitted by the selector to the transistor so as to fully conduct the transistor, and an output voltage value of the transistor is equal to the supply voltage value.

Another aspect of the present disclosure is to provide a control method of a low dropout regulator. The control method includes the following operations: selecting a first path of a selector when a supply voltage value is less than a supply voltage threshold value; transmitting a first selector voltage value to a transistor through the first path; and fully conducting the transistor so that an output voltage value of the transistor is equal to the supply voltage value.

In sum, the embodiments of the present disclosure are to provide a low dropout regulator and a control method thereof, so as to maintain the LDO output voltage value when the supply voltage value is close to the target LDO output voltage value by using a selector to control the voltage value input to the gate terminal of the pass transistor of the LDO, in which the pass transistor is used as a switch to pass logic levels between nodes of a circuit.

BRIEF DESCRIPTION OF THE DRAWINGS

The present disclosure can be more fully understood by reading the following detailed description of the embodiment, with reference made to the accompanying drawings as follows.

DETAILED DESCRIPTION

In order to make the description of the disclosure more detailed and comprehensive, reference will now be made in detail to the accompanying drawings and the following embodiments. However, the provided embodiments are not used to limit the ranges covered by the present disclosure; orders of step description are not used to limit the execution sequence either. Any devices with equivalent effect through rearrangement are also covered by the present disclosure.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," or "includes" and/or "including" or "has" and/or "having" when used in this specification, specify the presence of stated features, regions, integers, steps, operations, elements, and/or components, but do not preclude the presence or addition of one or more other features, regions, integers, steps, operations, elements, components, and/or groups thereof.

In this document, the term "coupled" may also be termed as "electrically coupled," and the term "connected" may be termed as "electrically connected." "Coupled" and "connected" may also be used to indicate that two or more elements cooperate or interact with each other.

Figure 1:
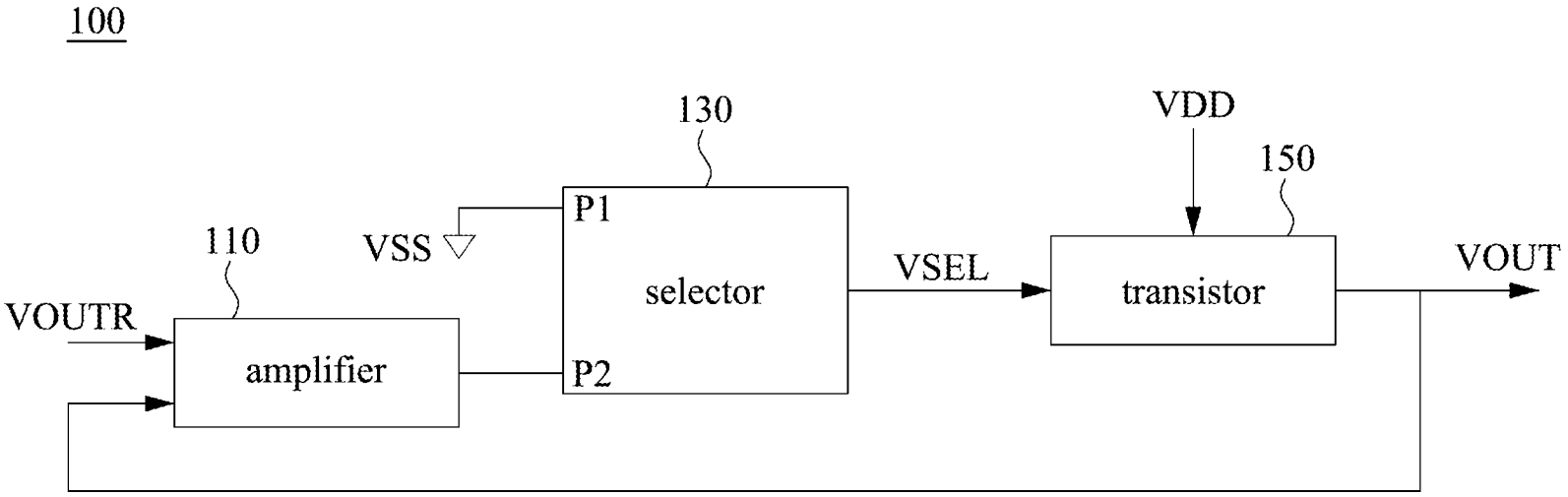
FIG. 1 is a schematic diagram of a low dropout regulator according to some embodiments of the present disclosure.

Reference is made to FIG. 1. FIG. 1 is a schematic diagram of a low dropout regulator (LDO) 100 according to some embodiments of the present disclosure. The low dropout regulator 100 includes an amplifier 110, a selector 130, and a transistor 150. In the connection relationship, the amplifier 110 is coupled to the selector 130, the selector 130 is coupled to the transistor 150, and the transistor is coupled to the amplifier 110. The LDO as illustrated in FIG. 1 is for illustrative purposes only, and the embodiments of the present disclosure are not limited thereto.

In some embodiments, when a supply voltage value VDD of the transistor 150 is less than a supply voltage threshold value, a path P1 of the selector 130 is selected, and a selector voltage value VSEL with the voltage value VSS is transmitted to the transistor 150 through the path P1. In some embodiments, when the transistor 150 is a p-type transistor and the voltage value VSS is 0, the transistor 150 is fully conducted, and an output voltage value VOUT is equal to the supply voltage value VDD.

Figure 2:
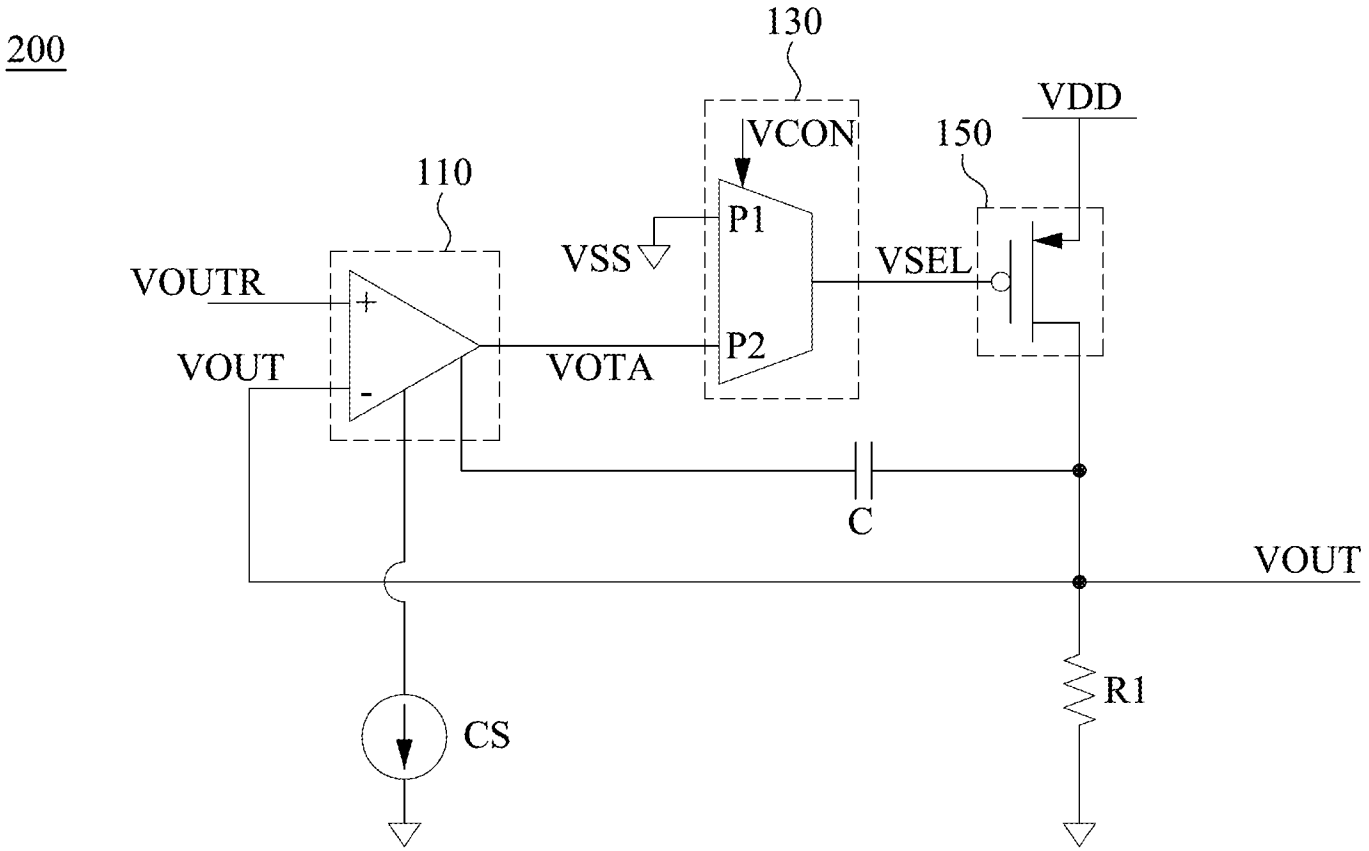
FIG. 2 is a schematic diagram of a low dropout regulator according to some embodiments of the present disclosure.

Reference is made to FIG. 2. FIG. 2 is a schematic diagram of a low dropout regulator (LDO) 200 according to some embodiments of the present disclosure. As illustrated in FIG. 2, in some embodiments, a first input end of the amplifier 110 receives the output voltage threshold value VOUTR, a second input end of the amplifier receives the output voltage value, and an output end of the amplifier outputs the amplifier output value VOTA.

Also, as illustrated in FIG. 2, in some embodiments, the selector 130 includes path P1 and path P2. Path P1 receives the voltage value VSS, and path P2 receives the amplifier output value VOTA from the selector 130. The selector 130 outputs the selector voltage value VSEL. The selector 130 is controlled by the control voltage value VCON. In some embodiments, the selector 130 is implemented as a multiplexer. However, the embodiments of the present disclosure are not limited thereto.

In some embodiments, the transistor 150 is a p-type transistor. A first end of the transistor 150 receives the supply voltage value VDD, a second end of the transistor 150 outputs the output voltage value VOUT, and a control end of the transistor 150 receives the selector voltage value VSEL. It should be noted that, the p-type transistor in the embodiments of the present disclosure is for illustrative purposes only, other transistors, such as n-type transistors, may be included within the scope of the present disclosure.

Furthermore, in some embodiments, the LDO 200 further includes a capacitor C connected between the amplifier 110 and the transistor 150. In some embodiments, the LDO 200 further includes a resistance R1 connected to the second end of the transistor 150. In some embodiments, the LDO 200 further includes a current source CS connected to the amplifier 110.

Figure 3:
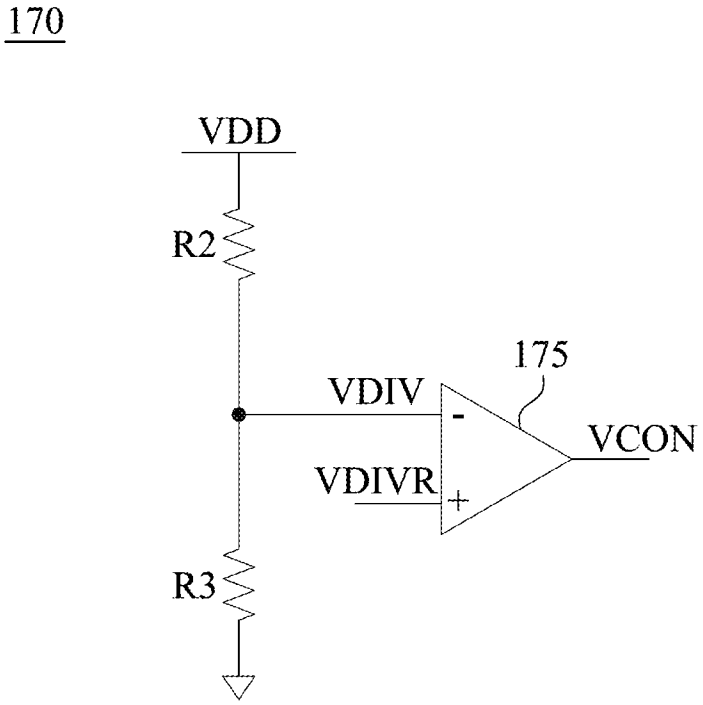
FIG. 3 is a schematic diagram of a control circuit according to some embodiments of the present disclosure.

Reference is made to FIG. 3. FIG. 3 is a schematic diagram of a control circuit 170 according to some embodiments of the present disclosure. In some embodiments, the LDO 200 further includes a control circuit 170. The control circuit 170 is coupled to the selector 130, and the control circuit 170 is configured to output the control voltage value VCON to the selector 130.

In some embodiments, when the supply voltage value VDD is less than the supply voltage threshold value, the control circuit 170 outputs a control voltage value VCON with a first value to the selector 130 so that the selector 130 selects the path P1. On the other hand, when the supply voltage value VDD is greater than the supply voltage threshold value, the control circuit 170 outputs a control voltage value VCON with a second value to the selector 130 so that the selector 130 selects the path P2.

As illustrated in FIG. 3, in some embodiments, the control circuit 170 includes a comparator 175, a resistor R2, and a resistor R3. A first input end of the comparator 175 receives a voltage division value VDIV of the supply voltage value VDD. A second input end of the comparator 175 receives an internal reference voltage value VDIVR.

In some embodiments, when the voltage division value VDIV is less than the internal reference voltage value VDIVR, the comparator 175 outputs the control voltage value VCON with the value of 1, and the path P1 of the selector 130 as illustrated in FIG. 2 is conducted. On the other hand, when the voltage division value VDIV is greater than the internal reference voltage value VDIVR, the comparator 175 outputs the control voltage value VCON with the value of 0, and the path P2 of the selector 130 as illustrated in FIG. 2 is conducted.

Reference is made to FIG. 2 again. In some embodiments, when the supply voltage value VDD is less than the supply voltage threshold value or when the supply voltage value VDD is close to the target output voltage value VOUT, the control circuit 170 as illustrated in FIG. 3 outputs the control voltage value VCON with the value of 1, and the path P1 of the selector 130 is conducted. When the path P1 of the selector 130 is conducted, the selector voltage value VSEL with the voltage value VSS is transmitted to the control end of the transistor 150. In some embodiments, the voltage value VSS is 0, and the transistor 150 is fully conducted, so that the output voltage value VOUT is equal to the supply voltage value VDD.

On the other hand, in some embodiments, when the supply voltage value VDD is greater than the supply voltage threshold value, the control circuit 170 as illustrated in FIG. 3 outputs the control voltage value VCON with the value of 0, and the path P2 of the selector 130 is conducted. When the path P2 of the selector 130 is conducted, the selector voltage value VSEL, which is equal to the amplifier output value VOTA of the amplifier 110, is transmitted to the control end of the transistor 150.

In some embodiments, when the output voltage value VOUT is less than the output voltage threshold value VOUTR, the amplifier output value VOTA input to the selector 130 from the amplifier 110 decreases, and then the output voltage value VOUT rises. On the other hand, when the output voltage value VOUT is greater than the output voltage threshold value VOUTR, the amplifier output value VOTA input to the selector 130 from the amplifier 110 increases, and then the output voltage value VOUT falls.

In some embodiments, a conductivity level of the transistor 150 is in inverse proportional to the amplifier output value VOTA, so as to achieve the feature mentioning above. In detail, when the amplifier output value VOTA decreases, the conductivity level of the transistor 150 is high. On the other hand, when the amplifier output value VOTA increases, the conductivity level of the transistor is low.

Figure 4:
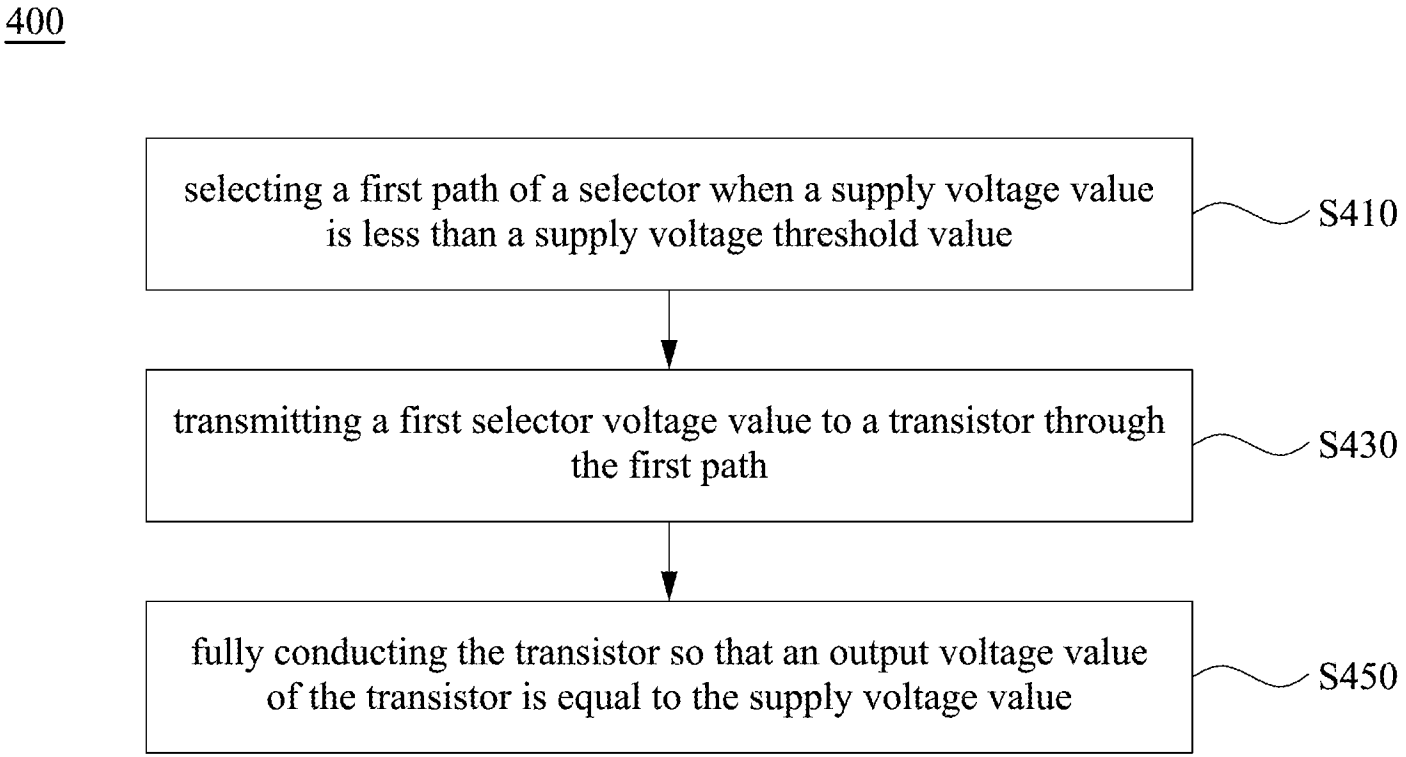
FIG. 4 is a flowchart illustrating the control method in accordance with some embodiments of the present disclosure.

Reference is made to FIG. 4. FIG. 4 is a flowchart illustrating the control method 400 in accordance with some embodiments of the present disclosure. It should be noted that the control method 400 can be applied to an electrical device having a structure that is the same as or similar to the structure of the low dropout regulator 100 shown in FIG. 1 and the low dropout regulator 200. To simplify the description below, the embodiments shown in FIG. 1 will be used as an example to describe the control method 400 according to some embodiments of the present disclosure. However, the present disclosure is not limited to application to the embodiments shown in FIG. 1, and FIG. 2. As shown in FIG. 4, the control method 400 includes operations S410 to S450.

In operation S410, a first path of a selector is selected when a supply voltage value is less than a supply voltage threshold value. In some embodiments, operation S410 may be operated by the selector 130 as illustrated in FIG. 2. For example, when the supply voltage value VDD is less than a supply voltage threshold value, path P1 of the selector 130 is selected.

In operation S430, a first selector voltage value is transmitted to a transistor through the first path. In some embodiments, operation S430 may be operated by the selector 130 as illustrated in FIG. 2. For example, in some embodiments, when the path P1 as illustrated in FIG. 2 is selected, the selector voltage value VSLE with the voltage value VSS is transmitted to the transistor 150 through the path P1.

In operation S450, the transistor is fully conducted so that an output voltage value of the transistor is equal to the supply voltage value. In some embodiments, operation S450 may be operated by the transistor 150 as illustrated in FIG. 2. For example, when the voltage value VSS transmitted to the control end of the transistor 150 is 0, the transistor 150 is fully conducted, and an output voltage value VOUT of the transistor VOUT is equal to the supply voltage value VDD.

According to the embodiment of the present disclosure, it is understood that the embodiments of the present disclosure are to provide a low dropout regulator and a control method thereof, so as to maintain the LDO output voltage value when the supply voltage value is close to the target LDO output voltage value by using a selector to control the voltage value input to the gate terminal of the pass transistor, such as the transistor 150 illustrated in FIG. 1, of the LDO Furthermore, when the load condition of the LDO is heavy, the pass transistor is also capable of providing an output voltage value VOUT with small error.

Although the present disclosure has been described in considerable detail with reference to certain embodiments thereof, other embodiments are possible. Therefore, the spirit and scope of the appended claims should not be limited to the description of the embodiments contained herein.

In addition, the above illustrations comprise sequential demonstration operations, but the operations need not be performed in the order shown. The execution of the operations in a different order is within the scope of this disclosure. In the spirit and scope of the embodiments of the present disclosure, the operations may be increased, substituted, changed and/or omitted as the case may be.

It will be apparent to those skilled in the art that various modifications and variations can be made to the structure of the present disclosure without departing from the scope or spirit of the present disclosure. In view of the foregoing, it is intended that the present disclosure cover modifications and variations of the present disclosure provided they fall within the scope of the following claims.

What is claimed is:

1. A low dropout regulator, comprising:

an amplifier;

a transistor, coupled to the amplifier; and a selector, coupled to the amplifier and the transistor, wherein when a supply voltage value of the transistor is less than a supply voltage threshold value according to a first control voltage value of a control circuit, a first path of the selector is selected and a first selector voltage value is transmitted by the selector to the transistor so as to fully conduct the transistor, and an output voltage value of the transistor is equal to the supply voltage value, wherein when the supply voltage value of the transistor is greater than the supply voltage threshold value, a second path of the selector is selected and a second selector voltage value is transmitted from the selector to the transistor, wherein when the output voltage value of the transistor is less than an output voltage threshold value, an amplifier output value input to the selector from the amplifier decreases, wherein when the output voltage value of the transistor is greater than the output voltage threshold value, the amplifier output value input to the selector from the amplifier increases.

2. The low dropout regulator of claim 1, further comprising:

the control circuit, coupled to the selector;

wherein when the supply voltage value is less than the supply voltage threshold value, the control circuit outputs the first control voltage value to the selector so that the selector selects the first path.

3. The low dropout regulator of claim 2, wherein the control circuit further comprises:

a comparator, wherein a first input end of the comparator receives a voltage division value of the supply voltage value, and a second input end of the comparator receives an internal reference voltage value;

wherein when the voltage division value is less than the internal reference voltage value, the comparator outputs the first control voltage value.

4. The low dropout regulator of claim 1, wherein a first input end of the amplifier receives the output voltage threshold value, a second input end of the amplifier receives the output voltage value of the transistor, and an output end of the amplifier outputs the amplifier output value.

5. The low dropout regulator of claim 1, wherein the transistor is a p-type transistor, and the first selector voltage value is 0.

6. A control method of a low dropout regulator, comprising:

selecting a first path of a selector when a supply voltage value is less than a supply voltage threshold value according to a first control voltage value of a control circuit;

transmitting a first selector voltage value to a transistor through the first path; and fully conducting the transistor so that an output voltage value of the transistor is equal to the supply voltage value;

selecting a second path of the selector when the supply voltage value is greater than the supply voltage threshold value; and transmitting a second selector voltage value to the transistor so as to regulate the output voltage value of the transistor;

decreasing an amplifier output value input to the second path of the selector when the output voltage value of the transistor is less than an output voltage threshold value; and increasing the amplifier output value input to the second path of the selector when the output voltage value of the transistor is greater than the output voltage threshold value.

7. The control method of claim 6, further comprising:

outputting the first control voltage value to the selector by the control circuit so that the first path is selected.

8. The control method of claim 7, further comprising:

outputting the first control voltage value when a voltage division value of the supply voltage value is less than an internal reference voltage value.

9. The control method of claim 6, wherein a conductivity level of the transistor is in inverse proportional to the amplifier output value.

10. The control method of claim 6, wherein the transistor is a p-type transistor, and the first selector voltage value is 0.

* * * * *